US007496299B2

(12) United States Patent
Aratachi

(10) Patent No.: US 7,496,299 B2
(45) Date of Patent: Feb. 24, 2009

(54) IMAGE FORMING APPARATUS

(75) Inventor: Tomitake Aratachi, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 245 days.

(21) Appl. No.: 11/640,864

(22) Filed: Dec. 19, 2006

(65) Prior Publication Data

US 2007/0147852 A1 Jun. 28, 2007

(30) Foreign Application Priority Data

Dec. 27, 2005 (JP) ..... P2005-375597

(51) Int. Cl.
*G03G 15/00* (2006.01)

(52) U.S. Cl. ..... 399/12; 399/13

(58) Field of Classification Search ..... 399/12, 399/13, 107, 110, 111, 114, 119, 120
See application file for complete search history.

(56) References Cited

U.S. PATENT DOCUMENTS 6,792,217 B2 * 9/2004 Nishino et al. ..... 399/12
6,871,026 B2 * 3/2005 Shimura et al. ..... 399/12
7,428,386 B2 * 9/2008 Itabashi ..... 399/12
2006/0193645 A1 * 8/2006 Kishi ..... 399/12
2007/0122165 A1 * 5/2007 Igarashi et al. ..... 399/12

FOREIGN PATENT DOCUMENTS

JP 2000-221781 8/2000

* cited by examiner

*Primary Examiner*—Hoan H Tran
(74) *Attorney, Agent, or Firm*—McDermott Will & Emery LLP

(57) ABSTRACT

An image forming apparatus includes: a developing unit; a housing section; a detecting unit; a protective member; and a displacement mechanism. The developing unit that houses a developer. The housing section removably houses the developing unit. The detecting unit is disposed in the housing section and detects developing unit information which is information on the developing unit, from the developing unit. The protective member is configured to be capable of displacing from a first arrangement protecting the detecting unit from surroundings of the detecting unit to a second arrangement allowing the detecting unit to detect the developing unit information. When the developing unit is mounted in the housing section, the displacement mechanism supplies the protective member with power to displace the protective member from the first arrangement to the second arrangement.

16 Claims, 14 Drawing Sheets

IMAGE FORMING APPARATUS

CROSS REFERENCE TO RELATED APPLICATION

This application claims priority from Japanese Patent Application No. 2005-375597 filed Dec. 27, 2005, the entire content of which is incorporated herein by reference.

TECHNICAL FIELD

The disclosure relates to an image forming apparatus including a developing unit that houses a developer, a housing section that removably houses the developing unit, and a detecting unit that is disposed in the housing section and that detects information on the developing unit from the developing unit.

BACKGROUND

Among image forming apparatuses configured in such a manner that a developing cartridge housing a toner is removably attached and in which the toner is fixed on a sheet of paper to form an image on the sheet of paper, an image forming apparatus proposed in Jpn. Pat. Appln. Laid-Open Publication No. 2000-221781 is provided with a photo interrupter in the housing section housing the developing cartridge, the photo interrupter being exposed in a manner of being opposite the developing cartridge.

Such image forming apparatus detects a protrusion of a gear provided in the developing cartridge by the photo interrupter in order-to allow the image forming apparatus to detect whether the developing cartridge is newly mounted in the image forming apparatus, and determines whether the developing cartridge is newly mounted in the image forming apparatus.

SUMMARY

However, as mentioned above, the photo interrupter is exposed in the conventional image forming apparatus. So, when the developing cartridge is mounted to or detached from the image forming apparatus, other members will possibly contact and damage the photo interrupter.

In view of the foregoing, it is an object of the invention to provide an image forming apparatus, which can protect the detecting unit that detects information on the developing unit and which does not obstruct detection by the detecting unit.

In order to attain the above and other objects, the invention provides an image forming apparatus including: a developing unit; a housing section; a detecting unit; a protective member; and a displacement mechanism. The developing unit that houses a developer. The housing section removably houses the developing unit. The detecting unit is disposed in the housing section and detects developing unit information which is information on the developing unit, from the developing unit. The protective member is configured to be capable of displacing from a first arrangement protecting the detecting unit from surroundings of the detecting unit to a second arrangement allowing the detecting unit to detect the developing unit information. When the developing unit is mounted in the housing section, the displacement mechanism supplies the protective member with power to displace the protective member from the first arrangement to the second arrangement.

BRIEF DESCRIPTION OF THE DRAWINGS

Illustrative aspects in accordance with the invention will be described in detail with reference to the following figures wherein:

FIG. 11(*b*) is a left side view of the detecting section of FIG. 10;

DETAILED DESCRIPTION

Figure 1:
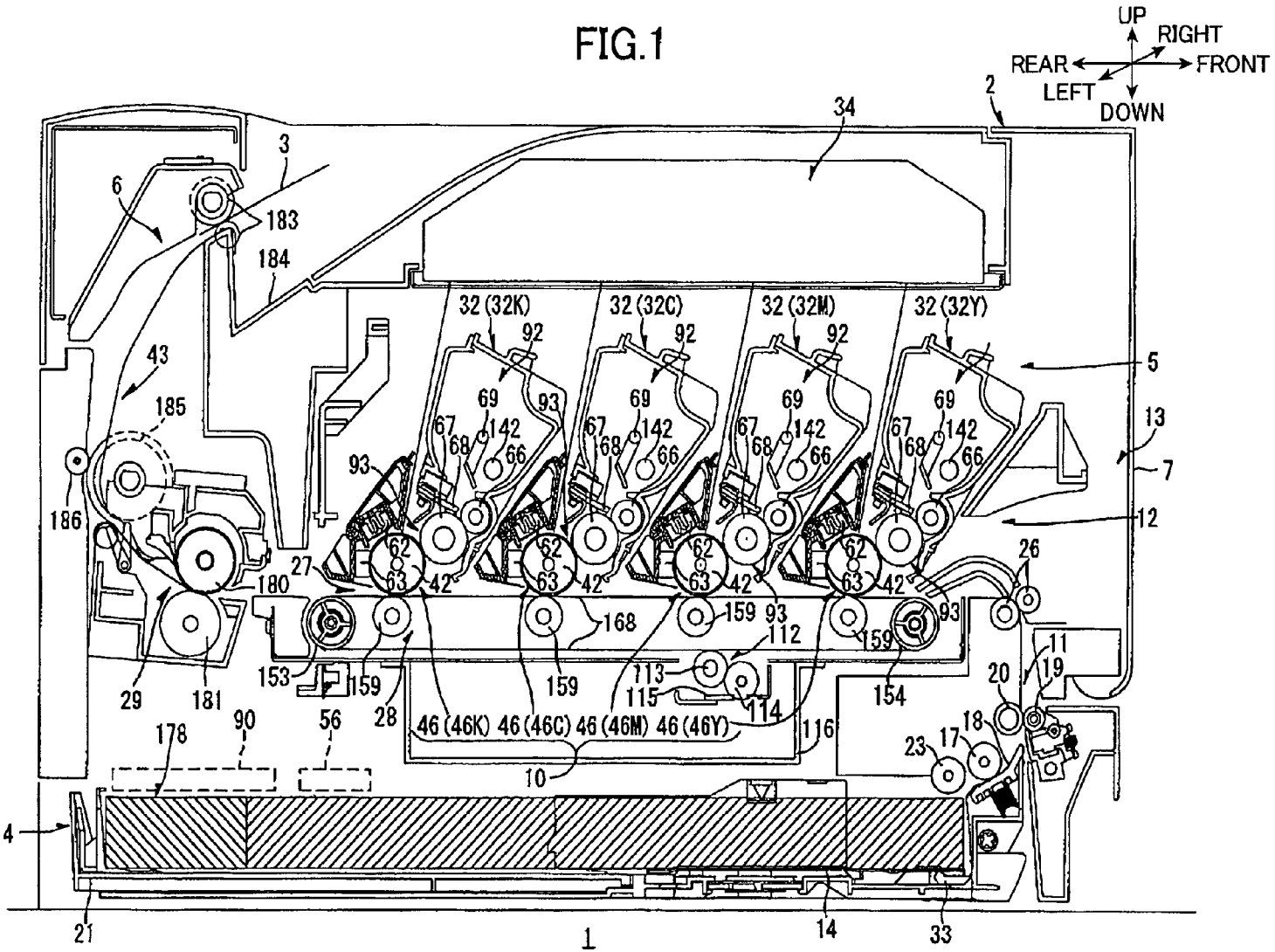
FIG. 1 is a side sectional view of a printer according to illustrative aspects of the invention.

An image forming apparatus according to some aspects of the invention will be described while referring to the accompanying drawings wherein like parts and components are designated, by the same reference numerals to avoid duplicating description.

The printer 1 includes a main casing 2 and, within the main casing 2, a feeding unit 4 for supplying sheets of a paper 3, an image-forming unit 5 for forming images on the paper 3 supplied from the feeding unit 4, and a discharge unit 6 for discharging the paper 3 after an image has been formed thereon.

In the following description, the terms "upward", "downward", "upper", "lower", "above", "below", "beneath", "right", "left", "front", "rear" and the like will be used throughout the description assuming that the printer 1 is disposed in an orientation in which it is intended to be used. In use, the printer 1 is disposed as shown in FIG. 1.

Unless otherwise stated below, directions in the following description of a processing unit 27 and developer cartridges 32 to be explained later will conform to the state in which the processing unit 27 and developer cartridges 32 are mounted in the main casing 2.

The main casing 2 is formed of a rectangular parallelepiped shape. In the central part of the inside thereof, there is formed a processing-unit housing section 12 that houses the processing unit 27. A CPU 90 and a motor 56 are mounted in the main casing 2. A front cover 7 is provided in an operable and closable in front of the main casing 2, and the processing-unit housing section 12 can be opened and closed by opening and closing the front cover 7.

Further, a paper discharge tray 184 is formed on the upper surface of the main casing 2. A sheet of paper 3 discharged from a paper discharge port formed above the rear end of the paper discharge tray 184 can be placed on the paper discharge tray 184.

The feeding unit 4 includes: a tray accommodating section 178 provided in the lower section of the main casing 2; a paper tray 21 for accommodating the paper 3 that can be slid into the tray accommodating section 178 in a front-to-rear direction from the front side of the main casing 2; a separating roller 17 and a separating pad 18; a feeding roller 23; a paper dust roller 19; a pinch roller 20; a paper-conveying path 11; and a pair of registration rollers 26. The paper tray 21 has a paper-pressing plate 14 and a feeding lever 33.

The image-forming unit 5 includes a scanning unit 34, the processing unit 27, a transfer unit 28, and a fixing unit 29.

A single scanning unit 34 is disposed in the top section of the main casing 2. Although not shown in the drawings, the scanning unit 34 includes a laser light-emitting unit, a polygon mirror, and a plurality of lenses and reflecting mirrors. The laser light-emitting unit emits laser beams based on image data for each color. The laser beams are scanned by the polygon mirror, pass through or are reflected by the plurality of lenses and reflecting mirrors, and are irradiated onto respective photosensitive drums 42 corresponding to each color. Thus, the scanning unit 34 forms electrostatic latent images on photosensitive layers of the photosensitive drums 42.

The processing unit 27 is disposed in the processing-unit housing section 12, and includes one drum unit 10 and four developing cartridges 32Y, 32M, 32C, and 32K.

The drum unit 10 includes four drum subunits 46Y, 46M, 46C, and 46K which are arranged in line from the front to the rear of the main casing 2.

The drum subunits 46 have the same configuration with one another. Each drum subunit 46 is provided with a photosensitive drum 42, a scorotron charger 62 and a cleaning brush 63.

The developing cartridges 32Y, 32M, 32C, and 32K are arranged in line from the front to the rear of the main casing 2. Each developing cartridge 32 is disposed opposing a corresponding drum subunit 46. The developing cartridges 32 have the same configuration with one another except that the developing cartridges 32 house toner of colors different from one another.

Each developing cartridge 32 has a toner containing chamber 92 and a development chamber 93 which are arranged substantially in the vertical direction. The developing cartridges 32Y, 32M, 32C, and 32K house toner of yellow, magenta, cyan, and black in their toner containing chambers 92, respectively. Each toner containing chamber 92 has a pair of detecting windows 142 through which the amount of a remainder of the toner housed therein can be detected from outside.

Each developer cartridge 32 includes an agitator 69, a supply roller 66, a developing roller 67, and a thickness-regulating blade 68 therein.

The agitator 69 is disposed in the toner containing chamber 92. At the time of forming an image, in response to an instruction from the CPU 90, drive force generated by the motor 56 is transmitted to the agitator 69, and the agitator 69 is driven to rotate. The agitator 69 has a rotation shaft and an agitating member extending radially outwardly from the rotation shaft. The agitator 69 agitates toner in the toner containing chamber 92.

The supply roller 66 is disposed at the upper part in the development chamber 93. At the time of forming an image, in response to an instruction from the CPU 90, drive force generated by the motor 56 is transmitted to the supply roller 66, and the supply roller 66 is driven to rotate. The supply roller 66 supplies toner supplied from the toner containing chamber 92 to the developing roller 67.

Further, the developing roller 67 is disposed at the lower part in the development chamber 93. The circumferential surface of the developing roller 67 abuts against both of the circumferential surface of the supply roller 66 and the circumferential surface (a photosensitive layer) of the photosensitive drum 42. At the time of forming an image, in response to an instruction from the CPU 90, drive force generated by the motor 56 is transmitted to the developing roller 67, and the developing roller 67 is driven to rotate. In this way, the developing roller 67 attaches toner supplied from the supply roller 66 to the electrostatic latent image formed on the photosensitive layer of the photosensitive drum 42 and develops the electrostatic latent image into a toner image. Note that a developing bias generated by a high-voltage substrate (not shown) disposed inside the main casing 2 is applied on the developing roller 67 at the time of forming an image.

As shown in FIG. 1, the transfer unit 28 is disposed in the main casing 2 below the drum unit 10. The transfer unit 28 includes a drive roller 153, a follow roller 154, a conveying belt 168, four transfer rollers 159, and a cleaning unit 112. The cleaning unit 112 is disposed below the conveying belt 168 and includes a primary cleaning roller 113, a secondary cleaning roller 114, a scraping blade 115, and a toner collector 116. The transfer unit 28 operates to transfer the toner images from the photosensitive drums 42 to the sheet of paper 3 supplied from the feeding unit 4.

The fixing unit 29 is disposed in the main casing 2 rearward of the drive roller 153. The fixing unit 29 includes a heating roller 180, and a pressure roller 181. The fixing unit 29 operates to thermally fix the toner images on the sheet of paper 3.

The discharge unit 6 is disposed at the rear end of the main casing 2 and includes a transport roller 185, a pinch roller 186, and a pair of paper discharge rollers 183.

Figure 2:
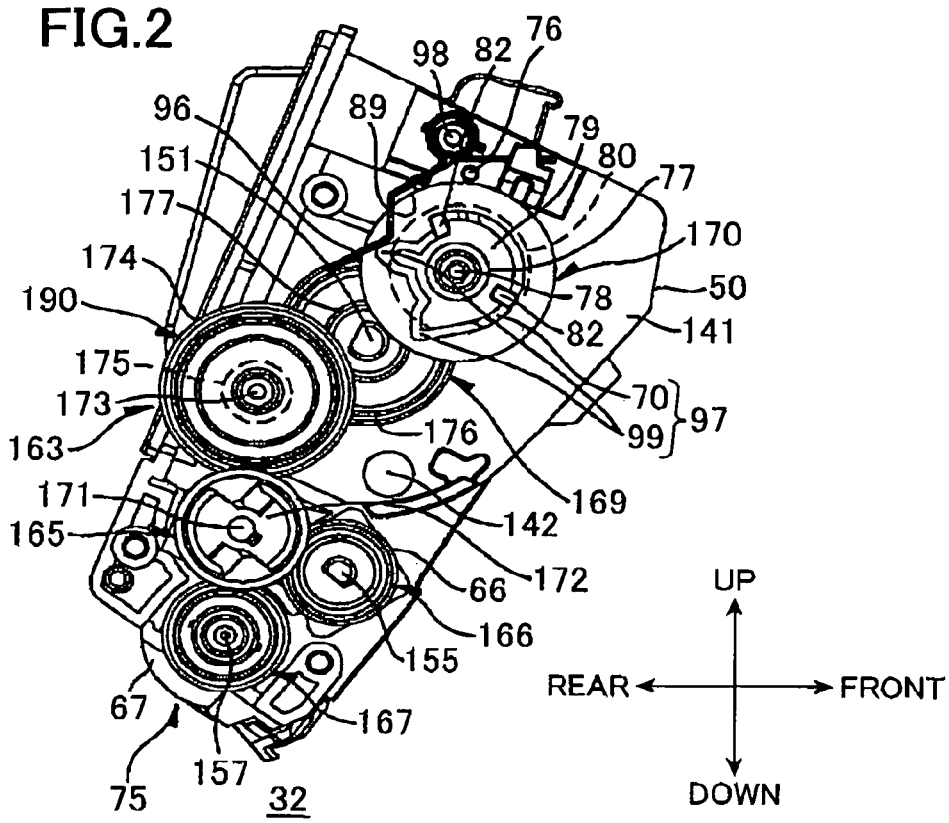
FIG. 2 is a left side view of a developing cartridge detachably mounted in the printer of FIG. 1.

As shown in FIG. 2, each developing cartridge 32 includes a developing frame. 50. The above-mentioned toner containing chamber 92 and the development chamber 93 are formed in the developing frame 50.

To be more specific, the developing frame 50 is formed in a box shape in which an opening 75 is formed at the lower end. The circumferential surface of the developing roller 67 is exposed from the opening 75, and the above-mentioned detecting window 142 is formed on each of the sidewalls 141 on both the left and right sides.

A gear mechanism section 163 is provided on the left sidewall 141 of the developing frame 50. The gear mechanism section 163 is for driving a rotating shaft 151 of the agitator 69, a supply roller shaft 155 of the supply roller 66, and a developing roller shaft 157 of the developing roller 67 to rotate.

The gear mechanism section 163 includes a coupling receiving gear 165, a supply roller drive gear 166, a developing roller drive gear 167, an intermediate gear 190, an agitator drive gear 169, and a detecting gear 170.

The coupling receiving gear 165 is rotatably supported by an input gear supporting shaft 171. The input gear supporting shaft 171 is located between the developing roller shaft 157 and the rotating shaft 151. The input gear supporting shaft 171 protrudes from the left sidewall 141 to the outside (the left side) in the width direction of the developing frame 50.

A coupling receiving part 172 is formed at the axial center of the coupling receiving gear 165, Drive force from the motor 56 is inputted to the coupling receiving part 172 when the developing cartridge 32 is mounted on the main casing 2.

The supply roller drive gear 166 is located in front of the coupling receiving gear 165, and is rotatably supported by the supply roller shaft 155 while being meshingly engaged with the coupling receiving gear 165.

The developing roller drive gear 167 is located below the coupling receiving gear 165, and is rotatably supported by the developing roller shaft 157 while being in meshingly engaged with the coupling receiving gear 165.

The intermediate gear 190 is located above the coupling receiving gear 165, and is rotatably supported by an intermediate gear support shaft 173 that protrudes from the left sidewall 141 to the outside (left side) in the width direction of the developing frame 50. The intermediate gear 190 is a two-stage gear having an outer teeth 174 on its outside and an inner teeth 175 on its inner side. The outer teeth 174 is meshingly engaged with the coupling receiving gear 165, while the inner teeth 175 is meshingly engaged with the agitator drive gear 169.

The agitator drive gear 169 is located in the upper front side of the intermediate gear 190, and is rotatably supported by the rotating shaft 151. The agitator drive gear 169 is a two-stage gear having an outer teeth 176 on its outside and an inner teeth 177 on its inner side. The outer teeth 176 is meshingly engaged with the inner teeth 175 of the intermediate gear 190, while the inner teeth 177 is meshingly engaged with the detecting gear 170.

The detecting gear 170 is located in the upper front side of the agitator drive gear 169, and is rotatably supported by a detecting gear support shaft 78 that protrudes from the left sidewall 141 to the outside (the left side) in the width direction of the developing frame 50.

The detecting gear 170 is formed as a missing teeth gear. More specifically, the detecting gear 170 has a detecting gear body 79 that is integrally formed with a teeth part 80, a missing teeth part 81 (see FIG. 4), and abutting protrusions 82. The detecting gear 170 is oriented such that the teeth part 80 and the missing teeth part 81 are opposite to the left sidewall 141.

The detecting gear body 79 is of a circular plate shape. The detecting gear support shaft 78 is inserted through the center of the detecting gear body 79. The detecting gear body 79 is rotatable relative to the detecting gear support shaft 78. A cylindrical insertion part 77 is formed in the center of the detecting gear body 79. The detecting gear body 79 has the teeth part 80 and the missing teeth part 81 on the surface of the circular plate on the right side thereof and the abutting protrusion 82 on the surface of the circular plate on the left side thereof. A rotary restricting claw 89 is formed at one spot on the circumference of the detecting gear body 79 and protrudes radially outwardly.

Figure 4:
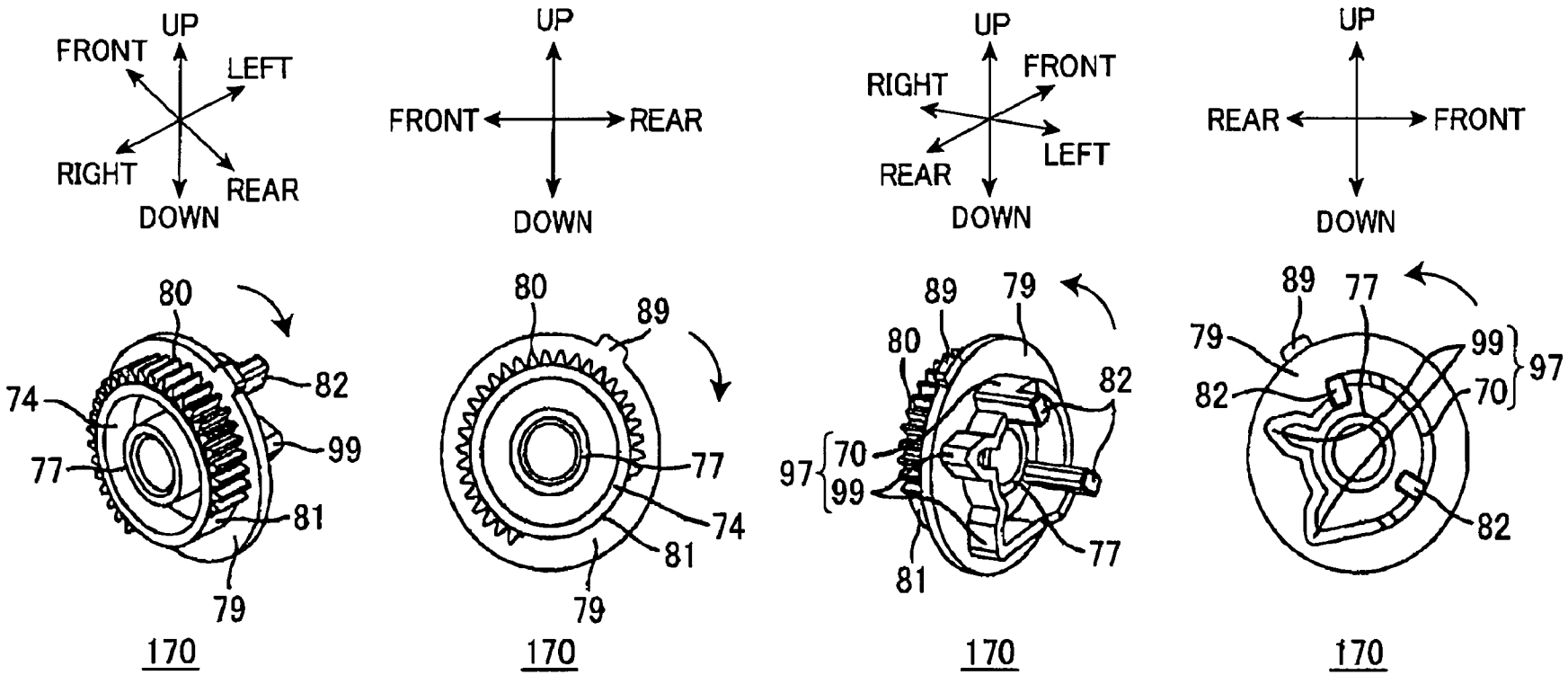
FIG. 4 illustrates views of a detecting gear seen from four different directions.

As shown in FIG. 4, on the teeth part 80 side (right side) of the detecting gear 170, there is formed a cylindrical part 74 disposed on a concentric circle relative to the circular plate shape of the detecting gear body 79. The teeth part 80 and the missing teeth part 81 are formed on the circumferential surface of this cylindrical part 74.

The teeth part 80 is formed as substantially a semicircular arc equivalent to an approximately two-third portion of the concentric circle in the cylindrical part 74. The inner teeth 177 of the agitator drive gear 169 mesh with the teeth part 80 so that the drive force from the motor 56 will be transmitted.

On the other hand, the missing teeth portion 81 is a part on the circumferential surface of the cylindrical part 74 where the teeth part 80 is not formed. The missing teeth portion 81 is formed as substantially a semicircular arc equivalent to an approximately one-third portion of the concentric circle in the cylindrical part 74. The missing teeth part 81 does not mesh with the inner teeth 177 of the agitator drive gear 169 so that transmission of the drive force from the motor 56 is shut off.

A guide rail 97 is formed on the abutting protrusion 82 side (left side) of the detecting gear 170. The guide rail 97 has no end and surrounds the circumference of the detecting gear support shaft 78.

The guide rail 97 has an approximately semicircular arc part 70 and an angular part 99. The approximately semicircular arc part 70 is an arc shape whose center is located on the detective gear support shaft 78. The angular part 99 connects both ends of the substantially semicircular arc part 70, and is of an approximately M shape whose two apexes protrude outwardly in the radial direction of the circular-shaped detecting gear body 79.

The abutting protrusion 82 is in a columnar shape protruding from the approximately semicircular arc part 70 of the guide rail 97 in a direction perpendicular to the surface of the detecting gear body 79.

The positions of the protrusions 82 relative to the teeth part 80 are set such that a lever member 91 to be explained later can abut against all the abutting protrusions 82 while the detecting gear 170 is rotating while its teeth part 80 being engaged with the inner teeth 177 of the agitator drive gear 169. More specifically, each abutting protrusion 82 is formed on the left side of the detecting gear 170 within a region that corresponds to a region on the right side of the detecting gear 170 where the teeth part 80 is provided. More specifically, the abutting protrusion 82 on the downstream side of the detecting gear 170 in the rotational direction is formed opposite to a location near to the downstream side end of the teeth part 80 in the rotational direction, and the abutting protrusion 82 on the upstream side of the detecting gear 170 in the rotational direction is located opposite to a location near to the upstream side end of the teeth part 80 in the rotational direction.

As shown in FIG. 2, the detecting gear support shaft 78 is inserted through the insertion part 77 of the detecting gear body 79 so that the detecting gear 170 is rotatable relative to the detecting gear support shaft 78, and the detecting gear 170 is urged by a coil spring 96 so that the downstream side end of the teeth part 80 in the rotational direction of the detecting gear 170 meshes with the inner teeth 177 of the agitator drive gear 169.

The coil spring 96 is wound on a boss member 98 protruding from the left sidewall 141 to the outside (left side) in the width direction of the developing frame 50. The one end of the coil spring 96 is fixed to the left sidewall 141. The other end of the coil spring 96 is locked to one angular part 99 of the detecting gear body 79. This causes the coil spring 96 to constantly urge the detecting gear 170 in the rotational direction in which the downstream side end of the teeth part 80 in the rotational direction of the detecting gear 170 is directed toward the inner teeth 177 of the agitator drive gear 169 to mesh with each other. Consequently, the downstream side end of the teeth part 80 in the rotational direction of the detecting gear 170 and the inner teeth 177 of the agitator drive gear 169 are continuously meshing with each other from when the developing cartridge 32 is newly produced by the manufacturer and until when the developing cartridge 32 is newly mounted in the printer 1.

Note that the total number of the abutting protrusion 82 formed on the detecting gear body 79 indicates information on the maximum number of sheets of paper 3 (hereinafter referred to as a "maximum sheet number of image formation") on which images can be formed by toner that is housed in the toner containing chamber 92 when the developing cartridge 32 is newly produced.

For example, when the developing cartridge 32 is newly produced to house toner whose amount can form images on 6,000 sheets of paper at maximum, the developing cartridge 32 is mounted with the detecting gear 170 of a type shown in FIG. 4 that has two abutting protrusions 82 that indicate 6,000 sheets as the maximum sheet number of image formation.

Figure 5:
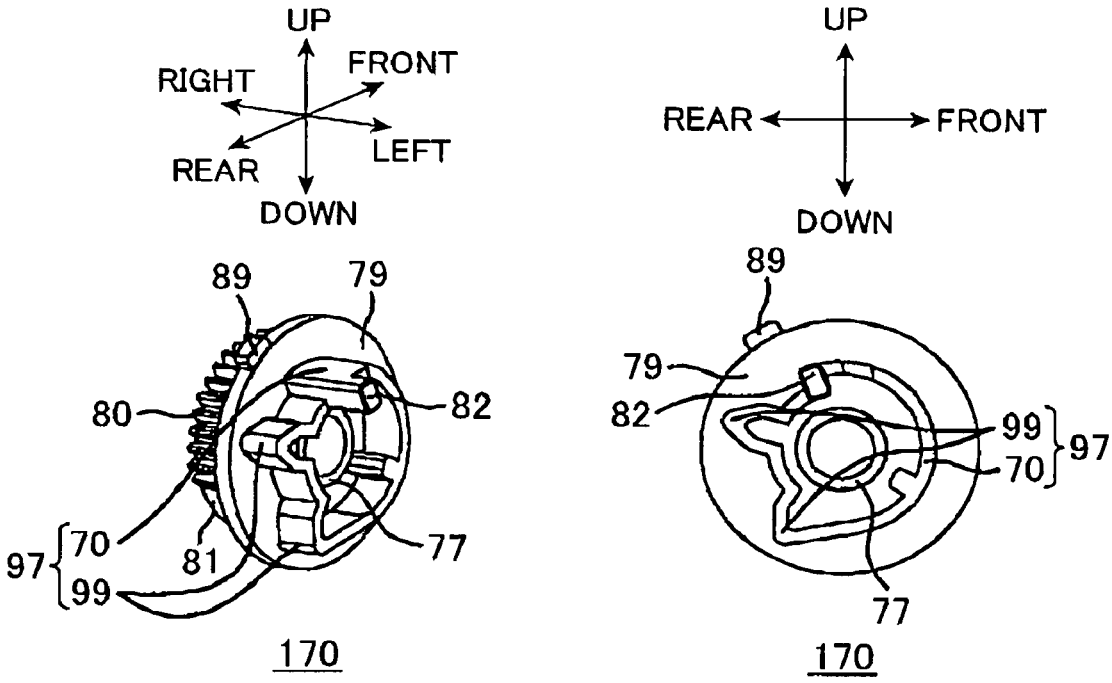
FIG. 5 illustrates views of another detecting gear seen from two different directions.

On the other hand, when the developing cartridge 32 is newly produced to house toner whose amount can form images on 3,000 sheets of paper at maximum, the developing cartridge 32 is mounted with the detecting gear 170 of another type that has only one abutting protrusion 82 shown in FIG. 5 that indicates 3,000 sheets as the maximum sheet number of image formation.

Figure 3:
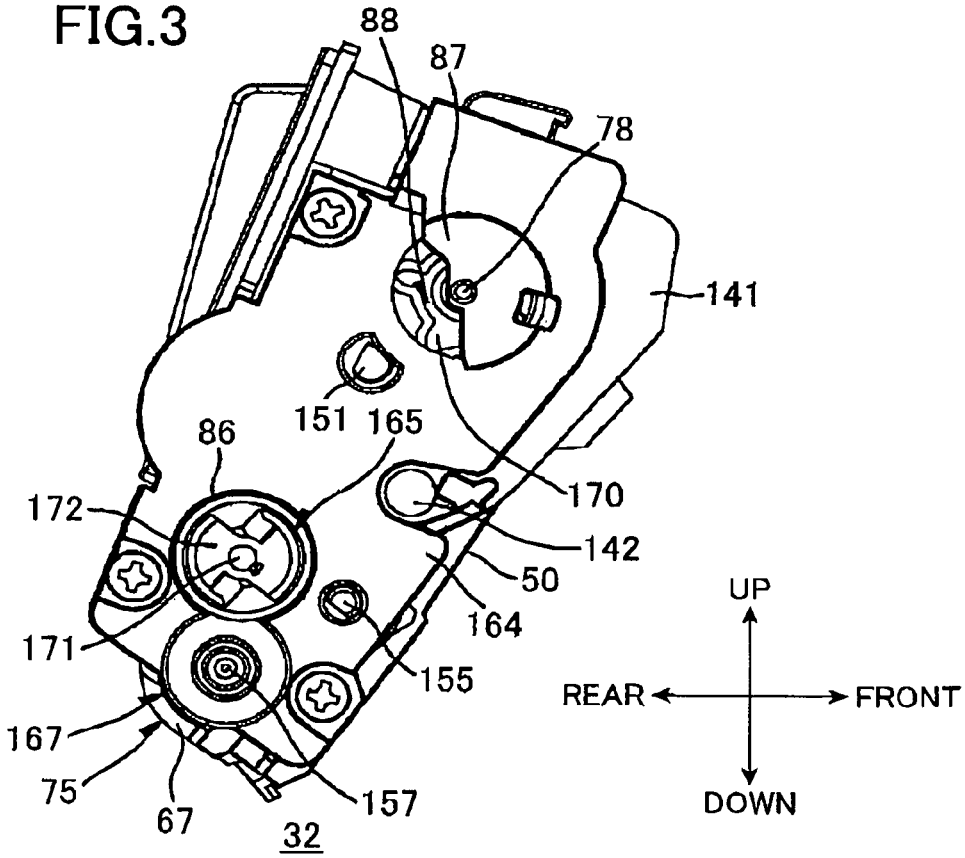
FIG. 3 is a left side view of the developing cartridge to which a gear cover is attached.

As shown in FIG. 3, a gear cover 164 is attached to the left sidewall 141 of the developing frame 50 in a manner of covering the gear mechanism section 163.

As shown in FIG. 3, a gear cover opening 86 for exposing the coupling receiving part 172 is formed at the lower part of the gear cover 164. A detecting gear cover part 87 is formed at the upper part of the gear cover 164 to cover the detecting gear 170.

The detecting gear cover part 87 is formed to expand toward the outside (left side) in the width direction of the developing frame 50 so as to house the detecting gear 170 therein. A detecting window 88 of a substantially open fan shape is formed at the rear side end of the detecting gear cover part 87 to expose the abutting projection 82.

Figure 6:
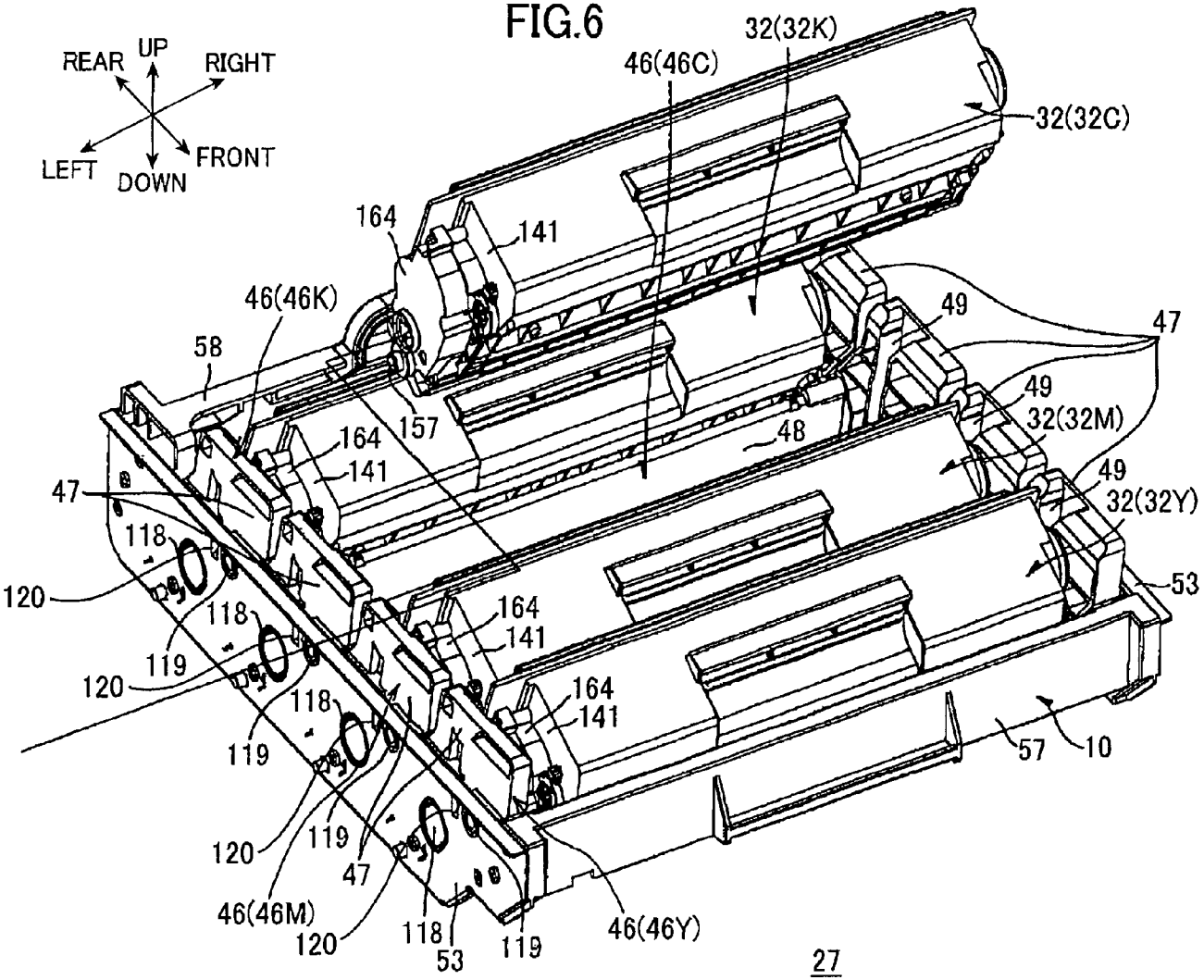
FIG. 6 is a perspective view of a processing unit detachably mounted in a processing-unit housing section of the printer of FIG. 1.

FIG. 6 shows the processing unit 27 in a condition in which a developing cartridge 32C is detached from the drum unit 10.

As shown in FIG. 6, in the processing unit 27, four developing cartridges 32 and four drum subunits 46 are disposed inside the drum unit 10 in line from the front to the rear of the processing unit 27.

The drum unit 10 has a frame having a rectangular planar shape that is constituted by a front beam 57, a rear beam 58, and a pair of side plates 53.

To be more specific, the drum unit 10 has the front beam 57 and the rear beam 58 that are disposed at the front end and the rear end of the drum unit 10, respectively, with the pair of side plates 53 being connected respectively to both left and right ends of the front beam 57 and the rear beam 58.

Flanges protrude from the upper ends of the pair of side plates 53 in the outward direction of the drum unit 10. These flanges engage with guide grooves (not shown) formed in the processing-unit housing section 12. With this configuration, the drum unit 10 is mounted in the processing-unit housing section 12 detachably in a direction along the front to back direction of the drum unit 10.

Four coupling outside insertion through-holes 118 are formed in the side plate 53 on the left side of the drum unit 10. Each coupling outside insertion through-hole 118 opposes the coupling receiving gear 165 of a corresponding developing cartridge 32.

Further, four light transmission through-holes 119 are formed on the side plate 53 on each of the left and right sides of the drum unit 10. Each light transmission through-hole 119 opposes the detecting window 142 of a corresponding developing cartridge 32. Only left side light transmission through-holes 119 are shown in FIG. 6.

Further, an outside protruding through-hole 120 is formed on the side plate 53 on the left side of the drum unit 10 at the rear of each light transmission through-hole 119. The outside protruding through-hole 120 is for allowing an abutting end 105 (see FIG. 7) of the lever member 91 to protrude from inside the drum unit 10. Note that this outside protruding through-hole 120 has a long planar shape extending substantially in the vertical direction.

Each drum subunit 46 has a frame that is constituted by a center frame 48 and a pair of side frames 47.

The center frame 48 is disposed inside the pair of side plates 53 of the drum unit 10 and extends parallel to the front beam 57 and the rear beam 58 of the drum unit 10. The pair of side frames 47 are connected to both left and right ends of the center frame 48. Note that the center frame 48 is configured such that the upper end thereof is inclined from the vertical direction by a specified angle toward the front of the drum unit 10.

A guide groove 49 is formed on the inside wall of each of the pair of side frames 47. The guide groove 49 extends from the upper end to the lower end of the side frame 47. The developing cartridge 32 is detachably supported to the drum subunit 46, with the developing roller shaft 157 of the developing roller 67 that protrude from both of the left and right sidewalls 141 of the developing cartridge 32 engaging with this guide groove 49.

Figure 7:
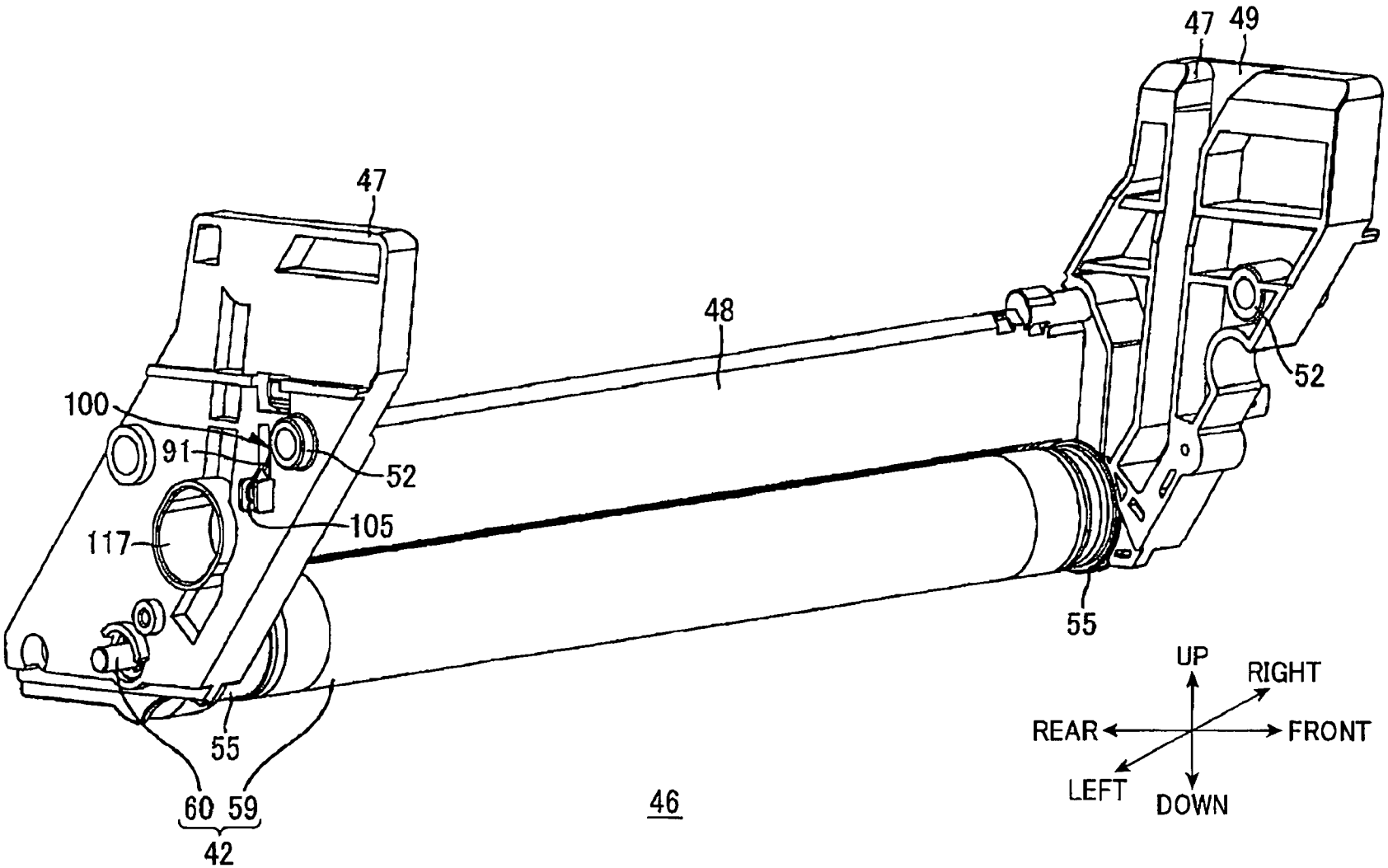
FIG. 7 is a perspective view of a drum subunit provided in the processing unit of FIG. 6.

As shown in FIG. 7, rotation supports 55 are formed on the inner sides of the pair of side frames 47 at their lower ends to rotatably support the drum body 59 of the photosensitive drum 42. Both ends of the drum body 59 are inserted into the rotation supports 55. A rotation shaft 60 of the photosensitive drum 42 protrudes outside from the lower ends of the pair of side frames 47.

A coupling inside insertion through-hole 117 is formed in the left side frame 47 at a location opposite to the coupling outside insertion through-hole 118 of the drum unit 10. Through the coupling outside insertion through-hole 118 and the coupling inside insertion through-hole 117, a coupling insertion part (not shown), to which drive force from the motor 56 is transmitted, can be connected to the coupling receiving part 172 of the developing cartridge 32 that is being mounted inside the drum unit 10.

Bosses 52 are formed in the pair of side frames 47 at locations opposite to the light transmission through-holes 119 of the drum unit 10. Thus, the outside of the drum subunit 46 is communicated, via the light transmission through-holes 119 and the bosses 52, with the detecting windows 142 of the developing cartridge 32 that is being mounted inside the drum unit 10.

An inside protruding through-hole 100 is formed in the left side frame 47 at a location opposite to the outside protruding through-hole 120 of the drum unit 10. The size and planar shape of the inside protruding through-hole 100 are the same as those of the outside protruding through-hole 120. This configuration enables the abutting end 105 of the lever member 91, which is disposed inside the left side frame 47, to protrude to the outside of the drum unit 10 through the outside protruding through-hole 120 and the inside protruding through-hole 100.

Figure 8:
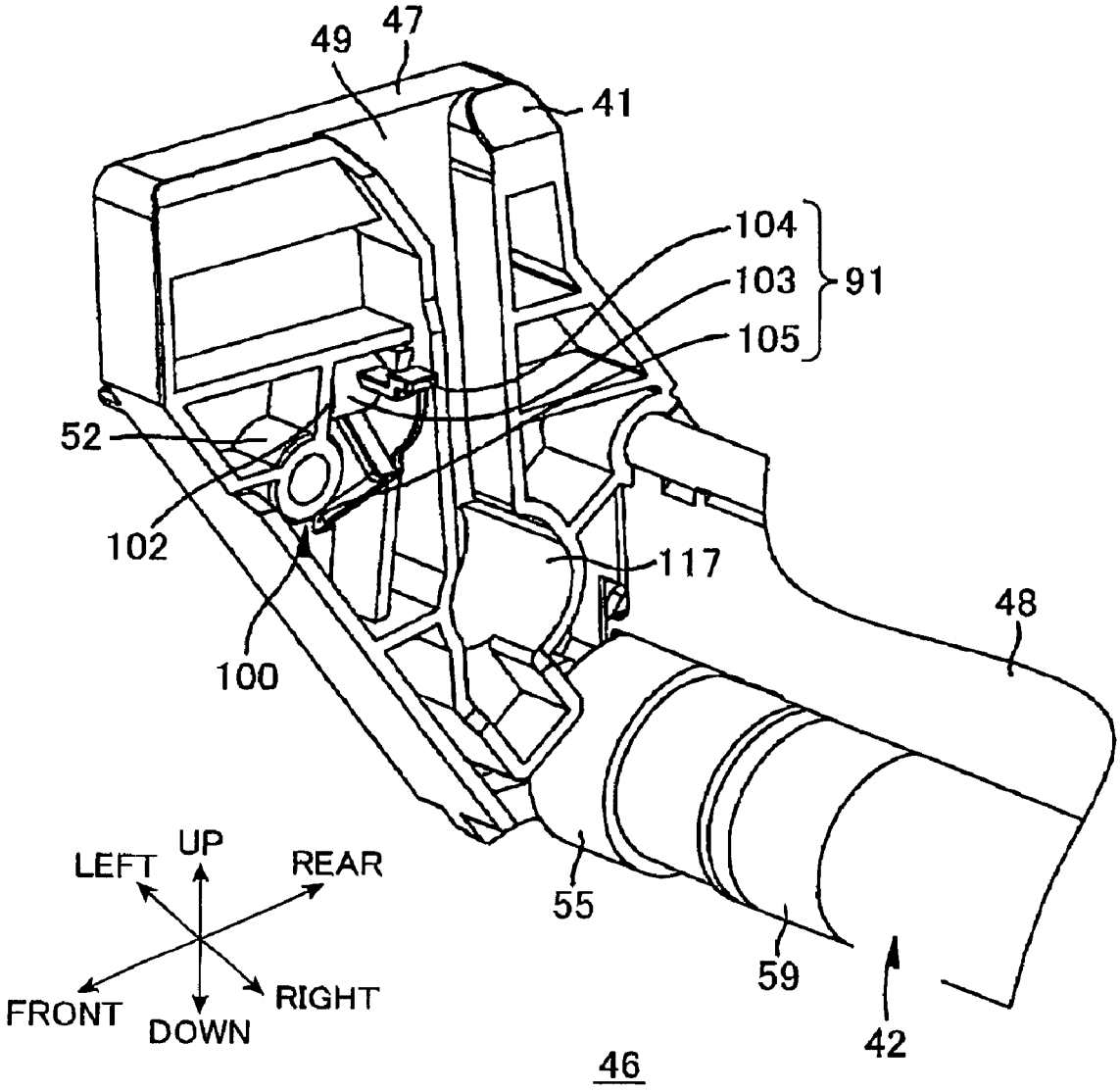
FIG. 8 is a perspective view of the inside of a side frame on the left side in the drum subunit of FIG. 7.

As shown in FIG. 8, a lever support shaft 102 of a cylindrical shape is formed on the inside of the left side frame 47 at the upper end of the inside protruding through-hole 100. The lever support shaft 102 extends from the front to the rear. The lever member 91 is supported on the lever support shaft 102 as being swingable in the thickness direction of the side frame 47.

Figure 9:
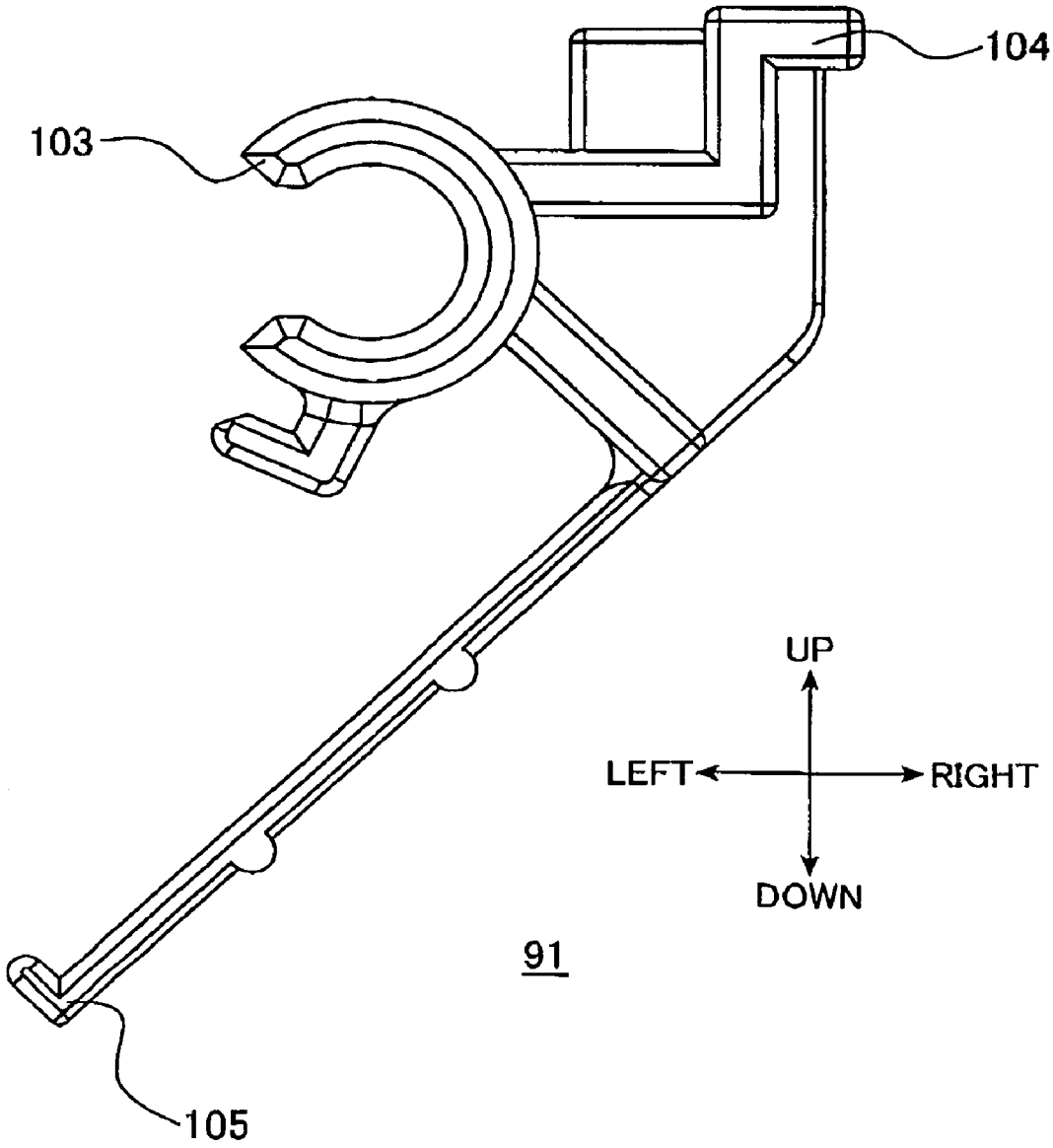
FIG. 9 is a plan view of a lever member mounted in the side frame on the left side in the drum subunit shown in FIG. 8.

As shown in FIG. 9, the lever member 91 is of a planar shape and has three ends: a support end 103, an input end 104 and the abutting end 105.

The support end 103 is formed in a cylindrical shape whose outer circumference is opened at its one segment. The lever member 91 is swingably supported on the lever support shaft 102, with the cylindrical portion of the support end 103 being fitted on the lever support shaft 102.

The input end 104 is formed at the right side of the support end 103. Each abutting protrusion 82 of the detecting gear 170 abuts against the input end 104.

Further, the abutting end 105 is formed in a rod shape extending from a location below substantially the center between the support end 103 and the input end 104 toward a location below the support end 103.

The support end 103 of the lever member 91 is supported by the lever support shaft 102. When the input end 104 is not abutting against the abutting protrusion 82, that is, when the lever member 91 is in the normal condition, the abutting end 105 is positioned below the support end 103 due to the weight of the abutting end 105. Note that the lever member 91 may be configured so that the abutting end 105 is positioned below the support end 103 due to not only the weight of the abutting end 105 but also the urging force of a spring or the like.

Figure 10:
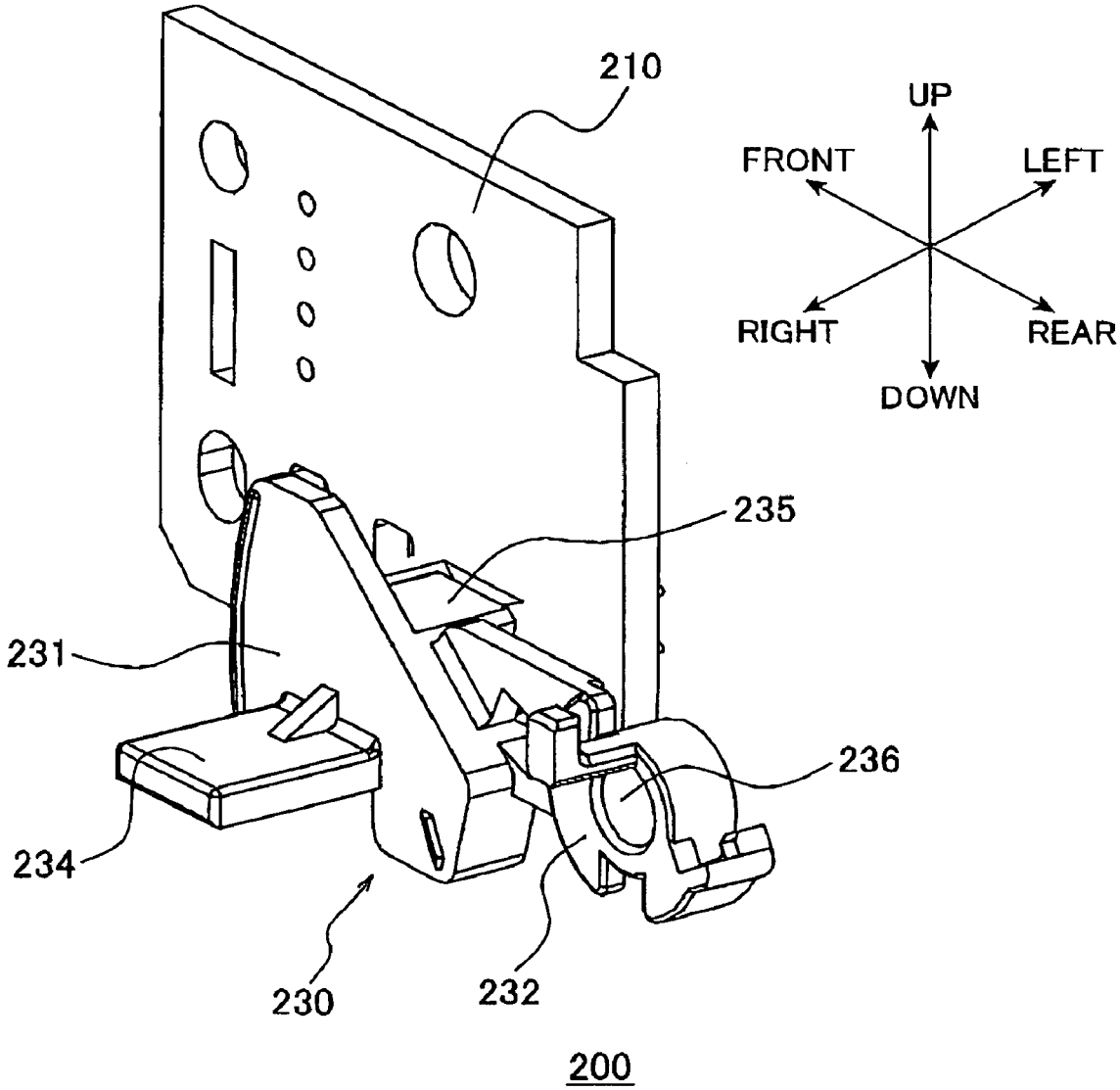
FIG. 10 is a perspective view of a detecting section provided in the processing-unit housing section in the printer of FIG. 1.
Figure 11A:
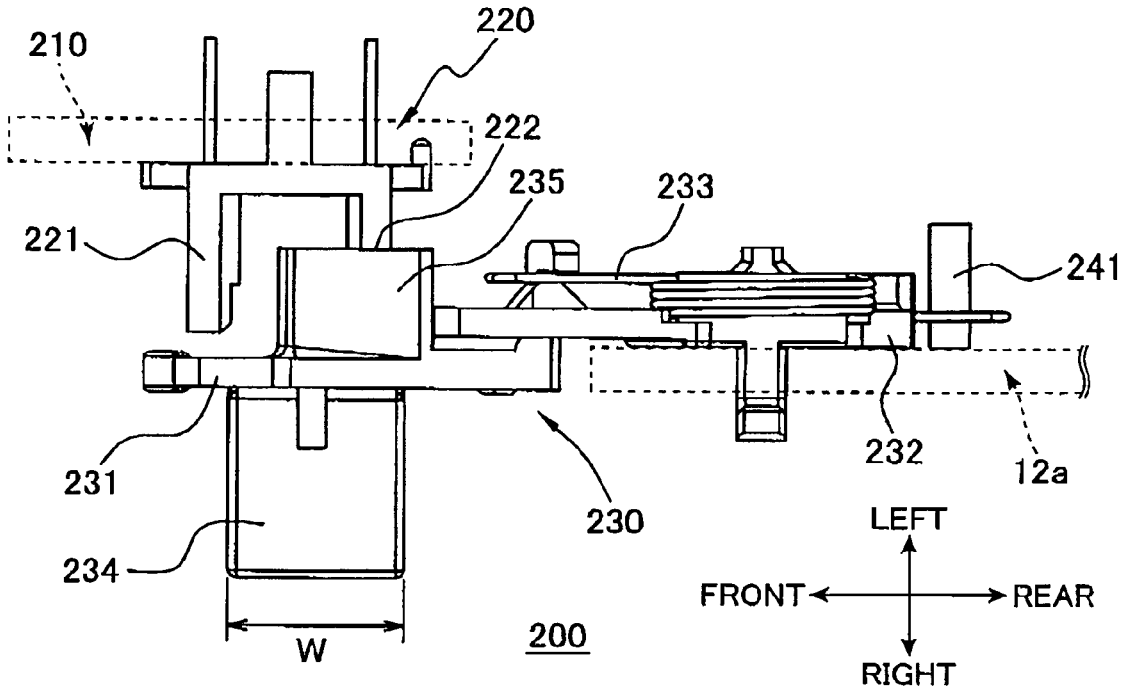
FIG. 11(*a*) is a plan view of the detecting section of FIG. 10 viewed from above.
Figure 11B:
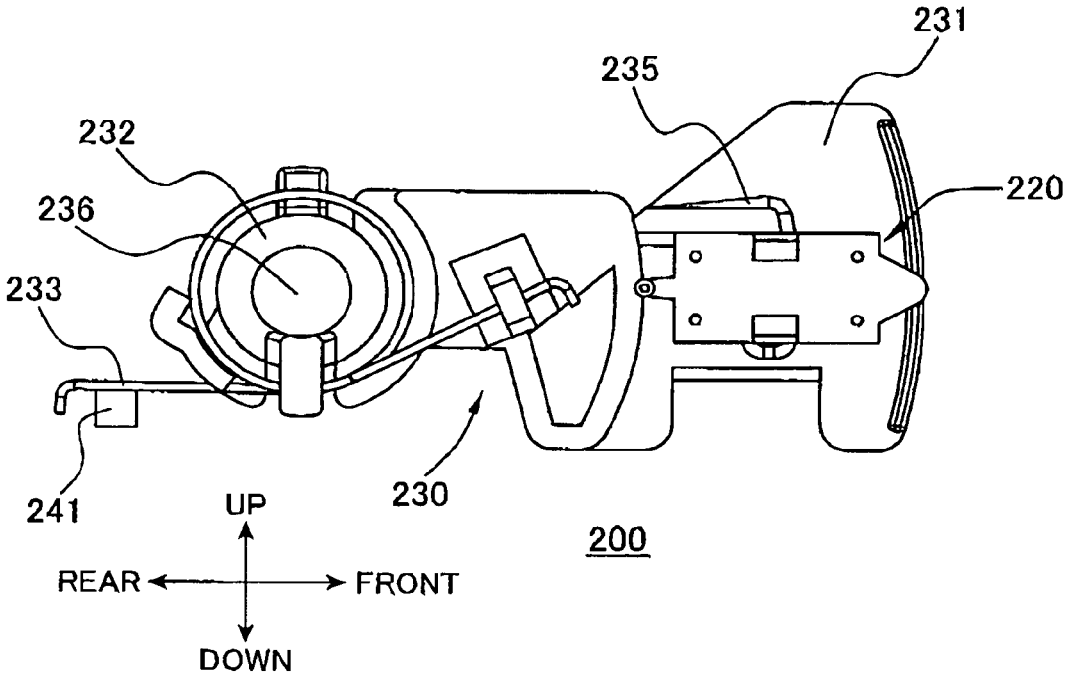

FIG. 10 is a perspective view of the detecting section 200 provided in the processing-unit housing section 12. FIG. 11(*a*) is a plan view of the detecting section 200 viewed from above, and FIG. 11(*b*) is a left side view of the detecting section 200. Note that in FIG. 11(*a*), for the sake of simplifying explanation, a substrate 210 and an inner wall 12*a* of the processing-unit housing section 12 on the left side thereof to be explained later are indicated by broken lines. In FIG. 11(*b*), illustration of the substrate 210 and the inner wall 12*a* on the left side of the processing-unit housing section 12 are omitted.

As shown in FIGS. 10 to 11(*b*), the detecting section 200 includes a photo interrupter 220 and a protective member 230.

The photo interrupter 220 is disposed on the substrate 210 that is attached to the internal wall 12*a* on the left side of the processing-unit housing section 12. The photo interrupter 220 is disposed at a location that the photo interrupter 220 will oppose the lever member 91 of the drum subunit 46 when the processing unit 27 is housed in the processing-unit housing section 12.

The photo interrupter 220 includes protrusions 221 and 222 which protrude in a direction toward the processing unit 27. The protrusions 221 and 222 are positioned opposite to each other at a specified interval therebetween in the front-to-rear direction. A light-emitting device and a light-receiving device are mounted in the protrusions 221 and 222, respectively.

The protective member 230 is disposed between the photo interrupter 220 and the processing unit 27. The protective member 230 includes; a protective part 231 for protecting the photo interrupter 220 from the surroundings; and a support part 232 for supporting the protective member 230 so as to allow the protective part 231 to swing upward.

The protective part 231 is formed in a plate shape with its pair of opposite sides facing the processing unit 27 and the photo interrupter 220, respectively. An abutted part 234 is formed on a surface of the protective part 231 on the processing unit 27 side. The abutting end 105 of the lever member 91 will abut against the abutted part 234 from below. A blocking part 235 is formed on the other surface of the protective part 231 on the photo interrupter 220 side. The blocking part 235 is of a V-shape and blocks between the light-emitting device and the light-receiving device of the photo interrupter 220. Note that a width W of the abutted part 234 in the front-to-back direction is larger than a range of shift in the front-to-back direction of the disposed position of the lever member 91, the shift being due to change in a housing condition of the processing unit 27.

The support part 232 is formed with an insertion through-hole 236. A support shaft (not shown) extending from the inner wall 12*a* on the left side of the processing-unit housing section 12 is inserted through the insertion through-hole 236. The protective member 230 is swingingly supported on the support shaft. The coil spring 233 is wound around the support shaft on the substrate 210 side of the support part 232. One end of the coil spring 233 is fixed to a fixing member 241. The fixing member 241 is located at the rear of the support part 232 and protrudes from the inner wall 12*a* on the left side of the processing-unit housing section 12. The other end of the coil spring 233 is fixed to a part of the support part 232 on the protective part 231 side. Accordingly, when the abutting end 105 of the lever member 91 is swung upward, the protective part 231 is pushed upward. Thereafter, when the abutting end 105 is swung downward, the protective part 231 returns downward due to its own weight and the urging force of the coil spring 233.

Next will be described, with reference to FIGS. 12(*a*)-12(*e*), how to determine whether or not the developing cartridge 32 is newly mounted and how to determine the maximum sheet number of image formation of the developing cartridge 32 when the developing cartridge 32 having the detecting gear 170 with two abutting protrusions 82 shown in FIG. 4 is newly mounted on the main casing 2.

Figures 12A, 12B, 12C:
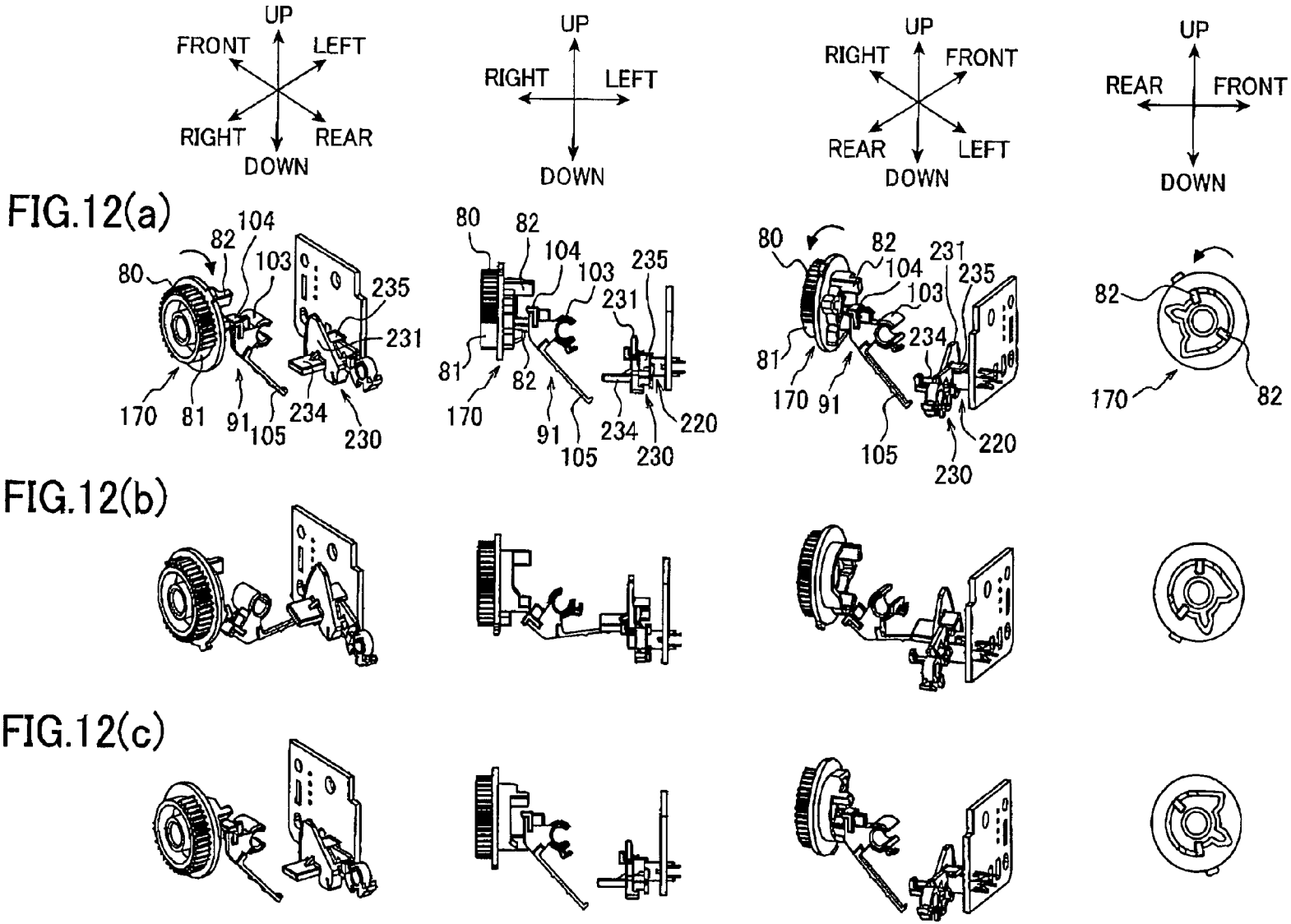
FIGS. 12(*a*) through 12(*e*) are explanatory diagrams showing operation relating to detection of whether the developing cartridge with the detecting gear of FIG. 4 is newly mounted in the printer.
Figures 12D, 12E:
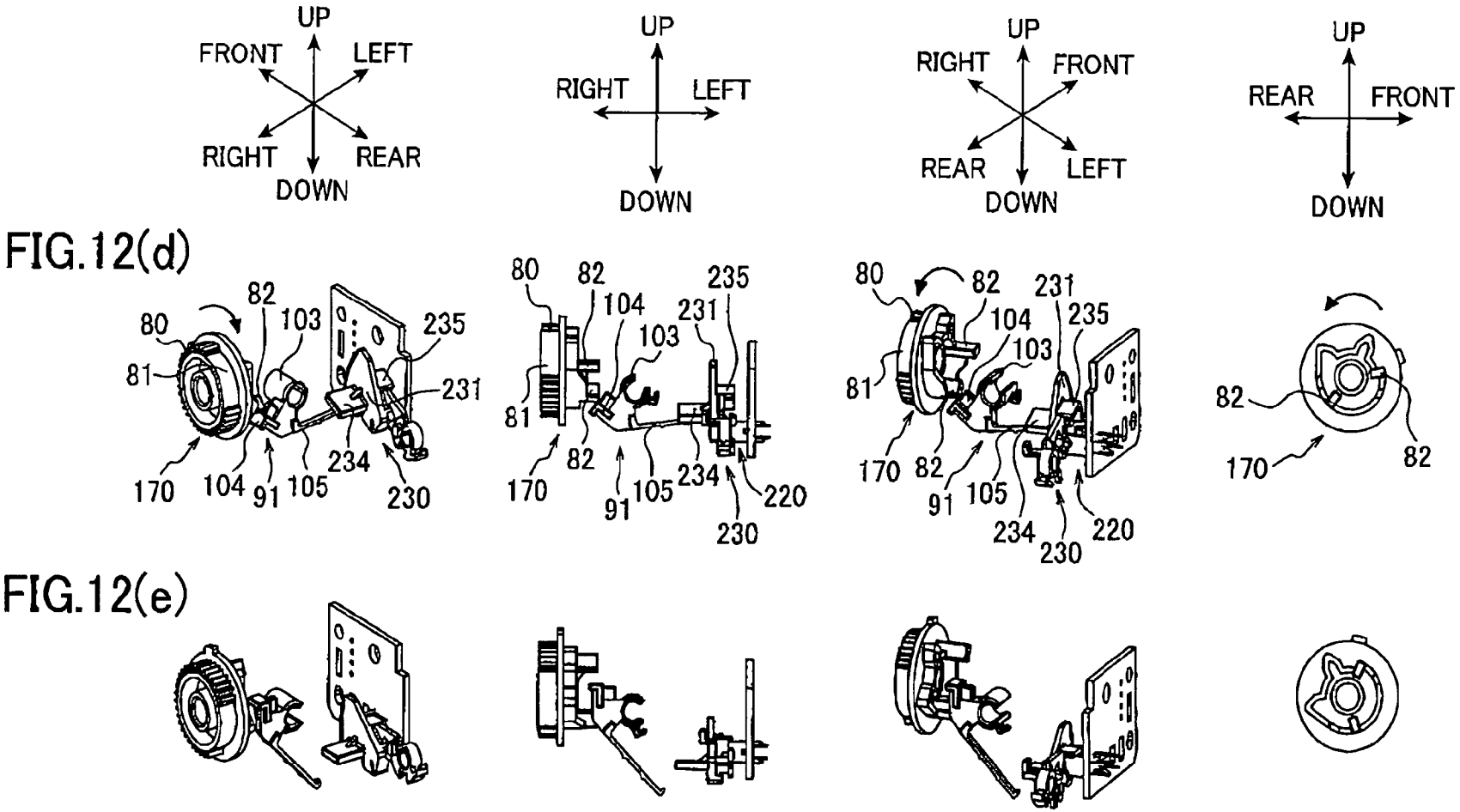

First, when the developing cartridge 32 is newly mounted, as shown in FIG. 12(*a*), the abutting protrusion 82 on the downstream side in the rotational direction of the detecting gear 170 is in a condition separate from the input end 104 of the lever member 91, which is now in the normal condition, in which the abutting end 105 is positioned below the support end 103 due to its own weight. The lever member 91 maintains the normal condition. In this condition, the protective part 231 of the protective member 230 is not pushed upward by the lever member 91. So, the protective part 231 of the protective member 230 protects the photo interrupter 220 from surroundings, while the blocking part 235 of the protective member 230 blocks light from the light-emitting device in the photo interrupter 220 so that the light is not received by the light-receiving device in the photo interrupter 220.

Next, the CPU 90 starts a warming up action. As a result, as shown in FIG. 12(*b*), the agitator 69 is driven to rotate, and the detecting gear 170 is also driven to rotate. Then, the abutting protrusion 82 on the downstream side in the rotational direction of the detecting gear 170 abuts against the input end 104 of the lever member 91, which is in the normal condition, from above to push the input end 104 downward. As a result, the lever member 91 swings with the support end 103 as the fulcrum so that the input end 104 moves downward and the abutting end 105 moves upward. The lever member 91 abuts against the abutted part 234 of the protective member 230 from below and pushes the protective part 231 of the protective member 230 upward. This enables light from the light-emitting device of the photo interrupter 220 to be received by the light-receiving device of the photo interrupter 220.

In response to this light reception, a light receiving signal is inputted from the light-receiving device to the CPU 90. The CPU 90 recognizes this light receiving signal as the first light receiving signal, and the counter is reset accordingly.

Figures 13A, 13B, 13C:
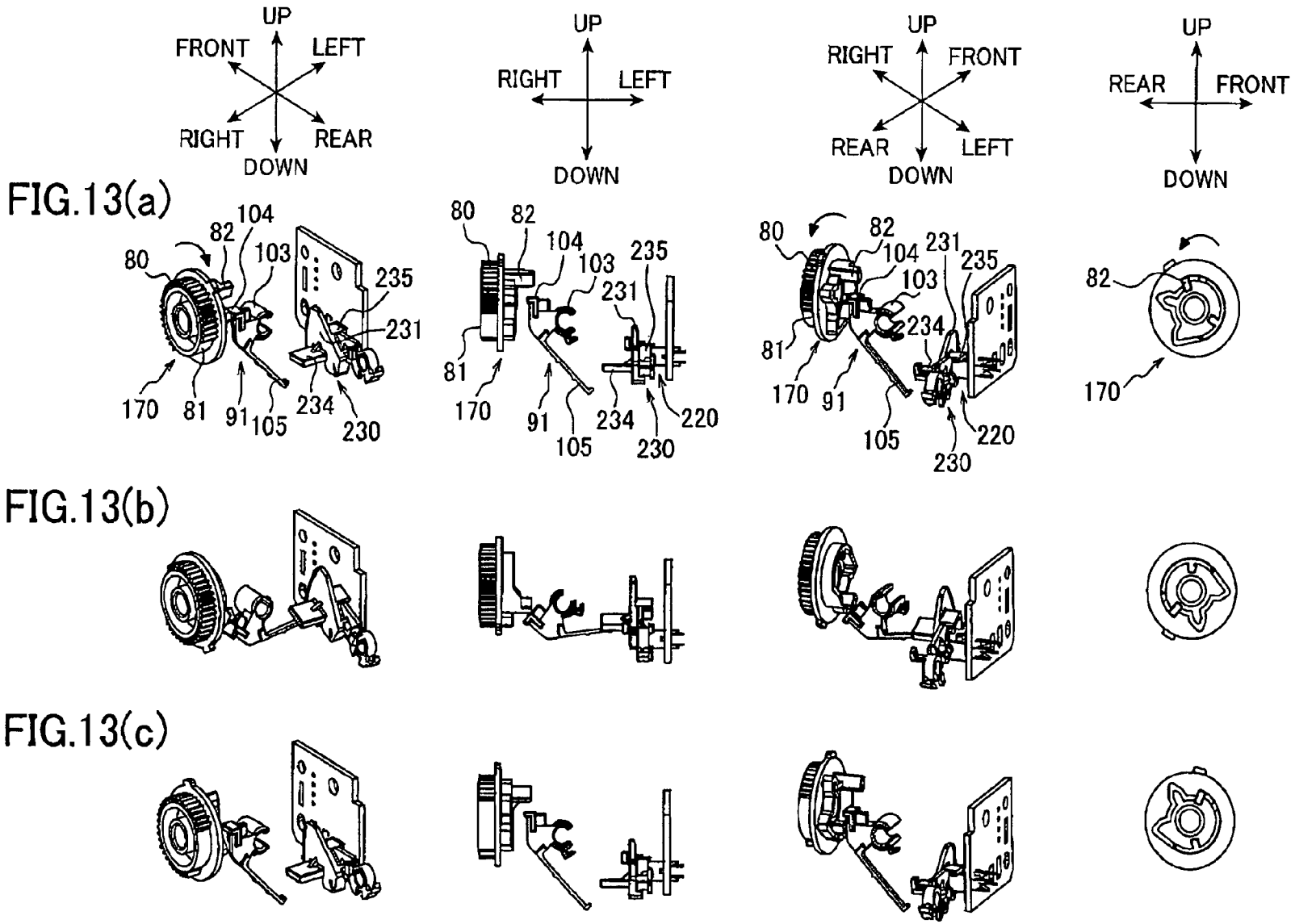
FIGS. 13(*a*) through 13(*c*) are explanatory diagrams showing another operation relating to detection of whether the developing cartridge with the detecting gear of FIG. 5 is newly mounted in the printer.

Thereafter, the abutting protrusion 82 continues applying downward pressure to the input end 104 while sliding with the input end 104, and then, as shown in FIG. 13(*c*), separates from the input end 104 in a manner of passing by the input end 104. This releases abutting of the abutting protrusion 82 against the input end 104. Due to the own weight of the abutting end 105, the lever member 91 then swings with the support end 103 as the fulcrum in such a way that the input end 104 moves upward and the abutting end 105 moves downward. The lever member 91 returns to the normal condition. As a result, due to the own weight of the protective part 231 and the urging force of the coil spring 233, the protective part 231 swings downward and the blocking part 235 again blocks light from the light-emitting device.

Then, the detecting gear 170 further rotates. As a result, the abutting protrusion 82 on the upstream side in the rotational direction of the detecting gear 170 abuts against the input end 104 of the lever member 91 from above to push the input end 104 downward. As a result, as shown in FIG. 12(*d*), the lever member 91 again swings with the support end 103 as the fulcrum so that the input end 104 moves downward and the abutting end 105 moves upward. The lever member 91 abuts against the abutted part 234 of the protective member 230 from below and pushes the protective part 231 of the protective member 230 upward. This again enables light from the light-emitting device of the photo interrupter 220 to be received by the light-receiving device of the photo interrupter 220.

In response to this light reception, a light receiving signal is again inputted from the light-receiving device to the CPU 90. The CPU 90 recognizes this light receiving signal as the second light receiving signal.

Thereafter, the abutting protrusion 82 of the upstream side continues applying downward pressure to the input end 104 while sliding with the input end 104, and then, as shown in FIG. 12(*e*), separates from the input end 104. This releases abutting of the abutting protrusion 82 against the input end 104. Due to the own weight of the abutting end 105, the lever member 91 then swings with the support end 103 as the fulcrum in such a way that the input end 104 moves upward and the abutting end 105 moves downward. The lever member 91 returns to the normal condition. As a result, due to the own weight of the protective part 231 and the urging force of the coil spring 233, the protective part 231 swings downward and the blocking part 235 again blocks light from the light-emitting device.

Subsequently, meshing between the teeth part 80 of the detecting gear 170 and the inner teeth 177 of the agitator drive gear 160 is released, and the rotational drive of the detecting gear 170 is stopped. Then, the warming up action including the rotation of the agitator 69 is finished.

In this way, the CPU 90 determines whether or not the developing cartridge 32 is mounted for the first time depending on the presence or absence of the light receiving signal. The CPU 90 further determines the maximum sheet number of image formation based on the number of times the CPU 90 has received the light receiving signal.

Assume that after newly mounting the developing cartridge 32 as described above, due to jamming of the sheet of paper 3, for example, the developing cartridge 32 is once removed together with the drum unit 10 from the processing-unit housing section 12 of the main casing 2, and is then mounted again together with the drum unit 10 on the processing-unit housing section 12 of the main casing 2. In this case, the detecting gear 170 maintains its condition out of engagement with the inner teeth 177 of the agitator drive gear 169. That is, the missing teeth part 81 is positioned opposing the inner teeth 177 of the agitator drive gear 169. Consequently, after the developing cartridge 32 is mounted again, even when the agitator 69 is rotated again in the warming up action as being controlled by the CPU 90, the detection gear 170 is not driven for rotation and no abutting protrusions 82 abut against the input end 104 of the lever member 91. Hence, there is no input of light receiving signals from the light-receiving device to the CPU 90. So, the CPU 90 correctly determines that the thus re-mounted developing cartridge 32 is mounted not for the first time. This ensures that the CPU 90 will continue performing accurate comparison calculation between the maximum sheet number of image formation that is determined when the developing cartridge 32 is newly mounted and the number of sheets of paper 3 that are actually printed with images.

Next will be described, with reference to FIGS. 13(*a*)-13(*c*), how to determine whether or not the developing cartridge 32 is newly mounted and how to determine the maximum sheet number of image formation of the developing cartridge 32 when the developing cartridge 32 having the detecting gear 170 with one abutting protrusion 82 shown in FIG. 5 is newly mounted on the main casing 2.

First, when the developing cartridge 32 is mounted, as shown in FIG. 13(*a*), the abutting protrusion 82 of the detecting gear 170 is in a condition separate from the input end 104 of the lever member 91 that is in the normal condition. The lever member 91 maintains the normal condition. In this condition, the protective part 231 of the protective member 230 is not pushed upward by the lever member 91. So, light from the light-emitting device in the photo interrupter 220 is blocked by the blocking part 235 of the protective member 230, and therefore is not received by the light-receiving device in the photo interrupter 220.

Next, the CPU 90 starts a warming up action. As a result, as shown in FIG. 13(*b*), the agitator 69 is driven to rotate, and the detecting gear 170 is also driven to rotate. Then, the abutting protrusion 82 of the detecting gear 170 abuts against the input end 104 of the lever member 91 from above to push the input end 104 downward. As a result, the lever member 91 swings with the support end 103 as the fulcrum so that the input end 104 moves downward and the abutting end 105 moves upward. The lever member 91 abuts against the abutted part 234 of the protective member 230 from below and pushes the protective part 231 of the protective member 230 upward. This enables light from the light-emitting device of the photo interrupter 220 to be received by the light-receiving device of the photo interrupter 220.

In response to this light reception, a light receiving signal is inputted from the light-receiving device to the CPU 90. The CPU 90 recognizes this light receiving signal as the first light receiving signal, and the counter is reset accordingly.

Thereafter, the abutting protrusion 82 of the forward side continues applying downward pressure to the input end 104 while sliding with the input end 104, and then, as shown in FIG. 13(*c*), separates from the input end 104 in a manner of passing by the input end 104. This releases abutting of the abutting protrusion 82 against the input end 104. Due to the own weight of the abutting end 105, the lever member 91 then swings with the support end 103 as the fulcrum in such a way that the input end 104 moves upward and the abutting end 105 moves downward. The lever member 91 returns to the normal condition. As a result, due to the own weight of the protective part 231 and the urging force of the coil spring 233, the protective part 231 swings downward and the blocking part 235 again blocks light from the light-emitting device.

Subsequently, meshing between the teeth part 80 of the detecting gear 170 and the inner teeth 177 of the agitator drive gear 160 is released, and the rotational drive of the detecting gear 170 is stopped. Then, the warming up action including the rotation of the agitator 69 is finished.

In this way, the CPU 90 determines whether or not the developing cartridge 32 is mounted for the first time depending on the presence or absence of the light receiving signal. The CPU 90 further determines the maximum sheet number of image formation based on the number of times the CPU 90 has received the light receiving signal.

As described above, according to the printer 1 of the present embodiment, when the processing unit 27 is detached from inside the processing-unit housing section 12, the protective part 231 of the protective member 230 is located opposing the photo interrupter 220, protecting the photo interrupter 220 from the surroundings. On the other hand, when the processing unit 27 with a developing cartridge 32 newly mounted therein is housed in the processing-unit housing section 12, the newly-mounted developing cartridge 32 causes the protective part 231 of the protective member 230 to swing upward, and allows the photo interrupter 220 to detect that the detecting cartridge 32 is newly mounted as well as the maximum sheet number of image formation.

In this manner, the photo interrupter 220 is protected, and still detection by the photo interrupter 220 is not obstructed.

Further, the protective part 231 of the protective member 230 is swung upward in connection with the rotation of the detecting gear 170. Thus, in connection with the operation of the processing unit 27 that is controlled by the CPU 90, the developing cartridge 32 can allow the photo interrupter to detect that the detecting cartridge 32 is newly mounted and to detect the maximum sheet number of image formation.

Further, since the lever member 91 is provided on the drum unit 10 (the drum subunit 46) side, even when the developing cartridge 32 has used up the toner and is discarded, the lever member 91 is not discarded and is to be used repeatedly.

Further, the lever member 91, upon receiving power from the abutting protrusion 82 of the detecting gear 170, swings the abutting end 105 upward to swing the protective part 231 of the protective member 230 upward. Thus, the photo interrupter 220 is controlled to carry out detection only when the photo interrupter 220 needs to detect that the developing cartridge 32 is new and when the maximum sheet number of image formation needs to be detected.

Further, since swinging the protective part 231 of the protective member 230 upward is a target of detection by the photo interrupter 220, both functions of detecting whether the developing cartridge 32 is newly mounted as well as detecting the maximum sheet number of image formation, and the protection of the photo interrupter 220 can be efficiently realized.

Further, since the protective member 230 is swung by the lever member 91, the protective member 230 can be swung even if the lever member 91 and the protective member 230 are disposed separate from each other at a fixed distance.

Further, since the abutted part 234 is configured to have the width W in the front-to-back direction that is larger than the range of shift of the lever member 91 in the front-to-back direction which is generated in accordance with a housing condition of the processing unit 27. So, it is ensured that the abutting end 105 of the lever member 91 abuts against the abutted part 234 and that the protective part 231 of the protective member 230 swings upward.

Further, since the urging force of the coil spring 233 acts upon the protective member 230, it is ensured that the protective part 231 swings downward after swinging upward to allow detection by the photo interrupter 220. In other words, when the photo interrupter 220 should be protected, the photo interrupter 220 can be protected with certainty.

While the invention has been described in detail with reference to the above aspects thereof, it would be apparent to those skilled in the art that various changes and modifications may be made therein without departing from the spirit of the invention.

Figure 14:
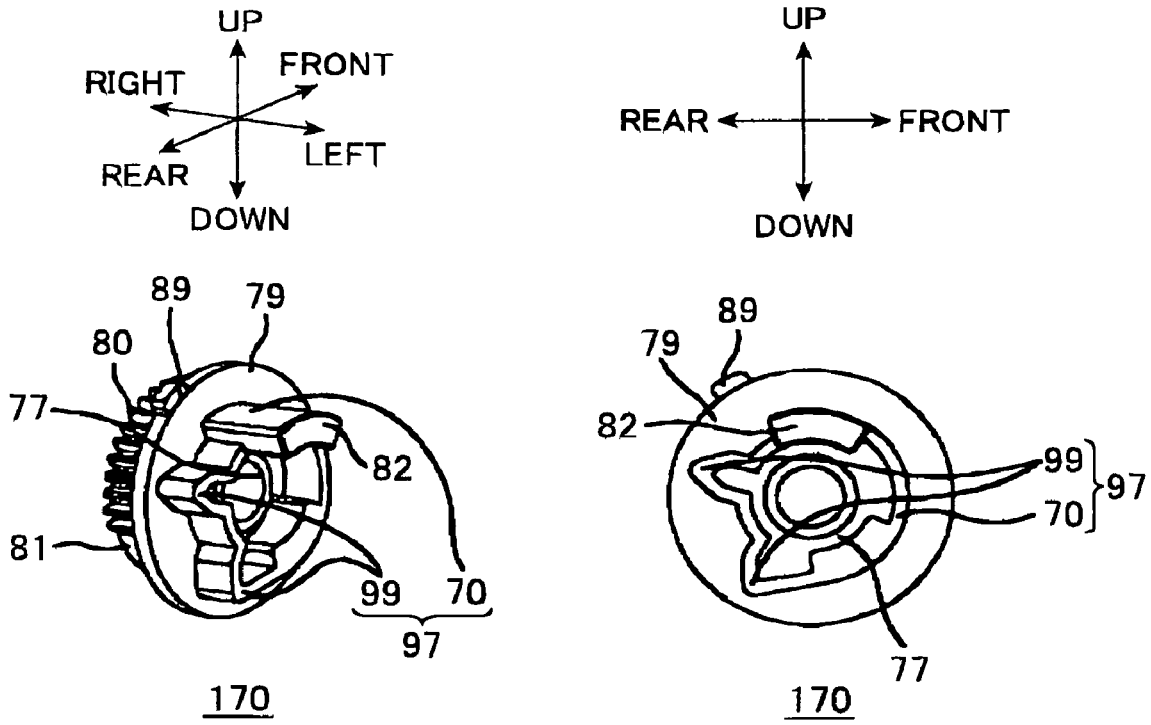
FIG. 14 illustrates views of a modification of the detecting gear seen from two different directions.

For example, in the above description, the CPU 90 determines the maximum sheet number of image formation based on the number of the abutting protrusions 82. However, determination may be made based on the size of the width of the abutting protrusion 82 as shown in FIG. 14. In this case, the CPU 90 determines the width of the abutting protrusion 82 based on the duration of time when the light-receiving signal is inputted.

Further, in the above description, the number of the abutting protrusions 82 is set according to the maximum sheet number of image formation. However, the number of the abutting protrusions 82 may be set according to other specifications of the developing cartridge 32 such as the color of the toner and the components of the toner.

Further, in the above description, the protective member 230 is configured to block the light of the light-emitting device of the photo interrupter 220 when the lever member 91 is in the normal condition. Alternatively, the configuration may be modified so that the light of the light-emitting device is blocked only when the protective part 231 is swung upward by the lever member 91. In this case, the CPU 90 makes determination based on the blocking signal inputted from the light-receiving device of the photo interrupter 220.

Further, in the above description, the lever member 91 is used to swing the protective part 231 of the protective member 230 upward. However, a mechanism other than the lever member 91 may be used to swing the protective part 231 of the protective member 230 upward.

Further, in the above description, the blocking part 235 of the protective member 230 is configured to block light in the photo interrupter 220. However, the abutting protrusion 82 may be configured to block light.

Further, in the above description, the lever member 91 is configured to swing the abutting end 105 upward upon receiving the power from the abutting protrusion 82. However, the lever member 91 may be configured to swing the abutting end 105 upward upon receiving the power from a source other than the abutting protrusion 82.

In the above description, the position and the orientation of the protective member 230 is displaced by abutting the abutting end 105 against the protective member 230. However, only the position or the orientation of the protective member 230 may be displaced from the protecting state, where the protective member 230 protects the photo interrupter 220, into the detecting state, where the protective member 230 allows light from the light-emitting device in the photo interrupter 220 to be received by the light-receiving device in the photo interrupter 220. That is, it is sufficient that at least one of the position and the orientation, that is, the arrangement, of the protective member 230 is displaced from the condition of protecting the photo interrupter 220 to the condition of allowing the photo interrupter 220 to perform its detection.

Further, the protective member 230 may be displaced from any other condition of arrangement of protecting the photo interrupter 220 to any other condition of arrangement of allowing the photo interrupter 220 to perform its detection.

In the above description, the lever member 91 displaces the protective member 230 by pushing up the protective member 230 in a vertical direction. However, the lever member 91 may displace the protective member 230 by pushing the protective member 230 in a direction that is shifted from the vertical direction to an extent that the protective member 230 can return to its original position due to its own weight.

In the above description, the photo interrupter 220 detects the protective member 230. However, the photo interrupter 220 may be modified to detect the lever member 91.

What is claimed is:

1. An image forming apparatus comprising:

a developing unit that houses a developer;

a housing section that removably houses the developing unit;

a detecting unit that is disposed in the housing section and that detects developing unit information which is information on the developing unit, from the developing unit;

a protective member that is configured to be capable of displacing from a first arrangement protecting the detecting unit from surroundings of the detecting unit to a second arrangement allowing the detecting unit to detect the developing unit information; and a displacement mechanism that, when the developing unit is mounted in the housing section, supplies the protective member with power to displace the protective member from the first arrangement to the second arrangement.

2. The image forming apparatus according to claim 1, wherein the displacement mechanism operates by receiving the power from the developing unit mounted in the housing section.

3. The image forming apparatus according to claim 2, wherein the developing unit comprises a driven member that is displaced by receiving the power from inside the housing section, and the displacement mechanism operates by receiving the power from the driven member.

4. The image forming apparatus according to claim 3, wherein the developing unit comprises:

an image carrier unit that has an image carrier on which an electrostatic latent image is formed; and a developing cartridge that houses the developer and that has a developer carrier supplying the developer to the image carrier, the driven member is installed in the developing cartridge, and the displacement mechanism is installed in the image carrier unit.

5. The image forming apparatus according to claim 3, wherein the driven member comprises a rotational member, on which a protrusion is formed and which rotates by receiving the power, and the displacement mechanism receives the power when the protrusion of the driven member abuts against the displacement mechanism.

6. The image forming apparatus according to claim 5, wherein at least one of a number or size of the protrusion of the driven member corresponds to contents of the developing unit information.

7. The image forming apparatus according to claim 6, wherein the developing unit information includes information on the developer housed in the developing unit.

8. The image forming apparatus according to claim 3, wherein the driven member is configured to rotate a predetermined amount when the developing unit is newly mounted in the housing section and to fail to rotate when the developing unit is mounted again in the housing section.

9. The image forming apparatus according to claim 8, wherein the driven member has a missing teeth gear that integrally has a teeth part and a missing teeth part and that rotates for the predetermined amount when the developing unit is newly mounted in the housing section.

10. The image forming apparatus according to claim 1, wherein the detecting unit detects displacement of the protective member to the second arrangement, thereby acquiring the developing unit information.

11. The image forming apparatus according to claim 5, wherein the detecting unit detects the protrusion, thereby acquiring the developing unit information.

12. The image forming apparatus according to claim 1, wherein the displacement mechanism comprises a lever member having an abutting end that abuts against the protective member and an input end that receives the power from the developing unit, and the lever member displaces the protective member from the first arrangement to the second arrangement when the input end of the lever member receives the power from the developing unit.

13. The image forming apparatus according to claim 12, wherein the size of a part of the protective member, against which the abutting end of the lever member abuts, is larger than a range of shift of the abutting end that is generated by a shift of a disposed position of the lever member.

14. The image forming apparatus according to claim 1, wherein the displacement mechanism displaces the protective member from the first arrangement to the second arrangement by supplying the protective member with the power to push up the protective member in a vertical direction.

15. The image forming apparatus according to claim 1, further comprising an urging unit generating an urging force to return the protective member from the second arrangement back to the first arrangement.

16. The image forming apparatus according to claim 1, further comprising an information determination unit determining contents of the developing unit information based on a result of detection by the detecting unit.

* * * * *